United States Patent [19]

Riddle et al.

[11] 3,994,634

[45] Nov. 30, 1976

[54] REVERSIBLE LUBRICANT PUMP

[75] Inventors: Arnold K. Riddle, Dearborn; Dale K. Bell, Ortonville, both of Mich.

[73] Assignee: Rockwell International Corporation, Pittsburgh, Pa.

[22] Filed: Oct. 28, 1975

[21] Appl. No.: 626,117

[52] U.S. Cl. ..... 418/32; 184/6.12; 418/102

[51] Int. Cl.[2] ..... F04C 15/04

[58] Field of Search ..... 184/6.12, 31; 417/315; 60/547, 548; 418/32, 102

[56] References Cited

UNITED STATES PATENTS

| | | | |
|---|---|---|---|
| 1,470,804 | 10/1923 | Buckingham | 417/315 |
| 1,595,381 | 8/1926 | Christensen | 418/32 |
| 1,717,814 | 6/1929 | Strong et al. | 184/6.12 |
| 2,136,318 | 11/1938 | Rossmann | 60/548;547 |
| 2,965,040 | 12/1960 | Eisenberg | 418/102 |
| 3,120,190 | 2/1964 | Schmitter et al. | 418/144 |
| 3,196,800 | 7/1965 | Hoffer | 418/71 |
| 3,590,954 | 7/1971 | Plantan | 184/6.12 |
| 3,852,004 | 12/1974 | Foster et al. | 418/131 |
| 3,857,461 | 12/1974 | Schmitt | 184/6.12 |

*Primary Examiner*—Richard C. Pinkham
*Assistant Examiner*—Arnold W. Kramer

[57] ABSTRACT

A reversible lubricant pump supplies oil to one of a pair of tandem drive axles. The pump includes a housing mounted on the axle helical gear cover to receive oil from an oil sump within the axle casing and to discharge oil to various components within the drive axle assembly. A drive gear and a driven gear are mounted within the housing for rotation in either direction to pump oil from a common inlet passage to a common outlet passage. The drive gear is mounted on a pump shaft which extends from within the housing to within the axle helical gear cover and has a pump gear fixedly mounted thereon. The pump gear is driven in response to movement of an input shaft of the axle assembly to cause the pump to operate in both the forward and reverse directions. A lubricating port within the housing extends from the pump discharge to the bearing of the pump shaft to provide the pump shaft with lubrication when the drive axle assembly is operated in the forward direction.

5 Claims, 4 Drawing Figures

REVERSIBLE LUBRICANT PUMP

BACKGROUND OF THE INVENTION

1. Field of the Invention

This invention relates to a reversible lubricant pump and, more specifically, to such a pump which can be utilized with each of the tandem drive axles of a heavy duty on-highway or off-highway vehicle.

2. Description of the Prior Art

Heretofore, lubrication for each axle of a heavy duty vehicle having tandem drive axles has been provided by splashing oil from an internal oil sump associated with each respective axle. When each axle is driven from a common drive shaft, as is sometimes the case for off-highway applications, this method of lubrication can provide satisfactory results. However, at low speeds, insufficient lubrication for the input axle bearing for each of the forward and rear axles has resulted in some problems.

But, more significantly, an interaxle differential is often employed to allow each axle to operate independently. The interaxle differential has been widely accepted for on-highway applications, and, as a result, additional lubricating problems soon became apparent. Since providing oil by splashing was insufficient for some slow speed operations, it is understandable that the total lack of rotation of a forward axle made possible by the interaxle differential has further proven splash lubrication to be inadequate. With rotation of the drive shaft, without rotation of the forward axle, the input shaft and the interaxle differential, which are located in the forward axle assembly, are forced to rotate.

These general lubricating problems exist whether the vehicle is being operated in a forward or a reverse direction. It is therefore also necessary to provide continuous lubrication independent of the direction of operation of the vehicle.

Although there has been in the past a number of reversible lubricant pumps, such as, for example, those disclosed in U.S. Pat. Nos. 1,717,814, 2,136,318 and 3,852,004, a reversible lubricant pump having improved features for the particular operating environment and working conditions of a heavy duty vehicle with tandem drive axles is desirable.

SUMMARY OF THE INVENTION

It is therefore an object of the present invention to provide a reversible lubricant pump for each of the forward and rear axle assemblies of a vehicle having tandem drive axles.

It is another object of the present invention to provide a pump of the type described which is adapted to be installed on the casing of an axle assembly to utilize as a supply the lubricating oil from an internal oil sump.

It is still another object of the present invention to provide a pump of the type described which is rugged and reliable for effective operation under the demanding working conditions of a heavy duty vehicle whether utilized for on-highway or off-highway applications.

To accomplish these and other objectives of the present invention, a preferred embodiment includes a reversible lubricant pump capable of supplying lubricating oil to various components of one of a pair of tandem drive axle assemblies which includes an axle casing and an oil sump. The pump includes a housing which, having a common inlet passage and a common outlet passage, is capable of being sealably received within an opening of the axle helical gear cover of the axle casing as the common inlet passage communicates with the oil sump and the common outlet passage communicates with the various components. A drive gear and a driven gear are mounted for engaged rotation within a pump cavity of the housing between a first and a second oil port for rotation in a first direction to pump oil from the first port to the second and in an opposite direction to pump oil from the second port to the first. A pair of supply lines extend from the common inlet passage to the first and second ports respectively and include check valves to prevent oil flow in a direction toward the common inlet passage. A pair of discharge lines within the housing extend from the common outlet passage to the first and second ports respectively and include check valves to prevent flow away from the common outlet passage. The drive gear is rigidly mounted on a first end of a pump shaft which is mounted for rotation within a bearing within the housing. The second end of the pump shaft extends to within the axle casing and has a pump gear fixedly mounted thereon. Gearing between the pump gear and the input shaft of the axle assembly insures that the pump will operate in either direction of rotation of the input shaft. A lubricating port within the housing extends from the second oil port to the interior of the pump shaft bearing to provide lubrication thereto during operation of the axle assembly.

DETAILED DESCRIPTION OF THE PREFERRED EMBODIMENT

Figure 1:
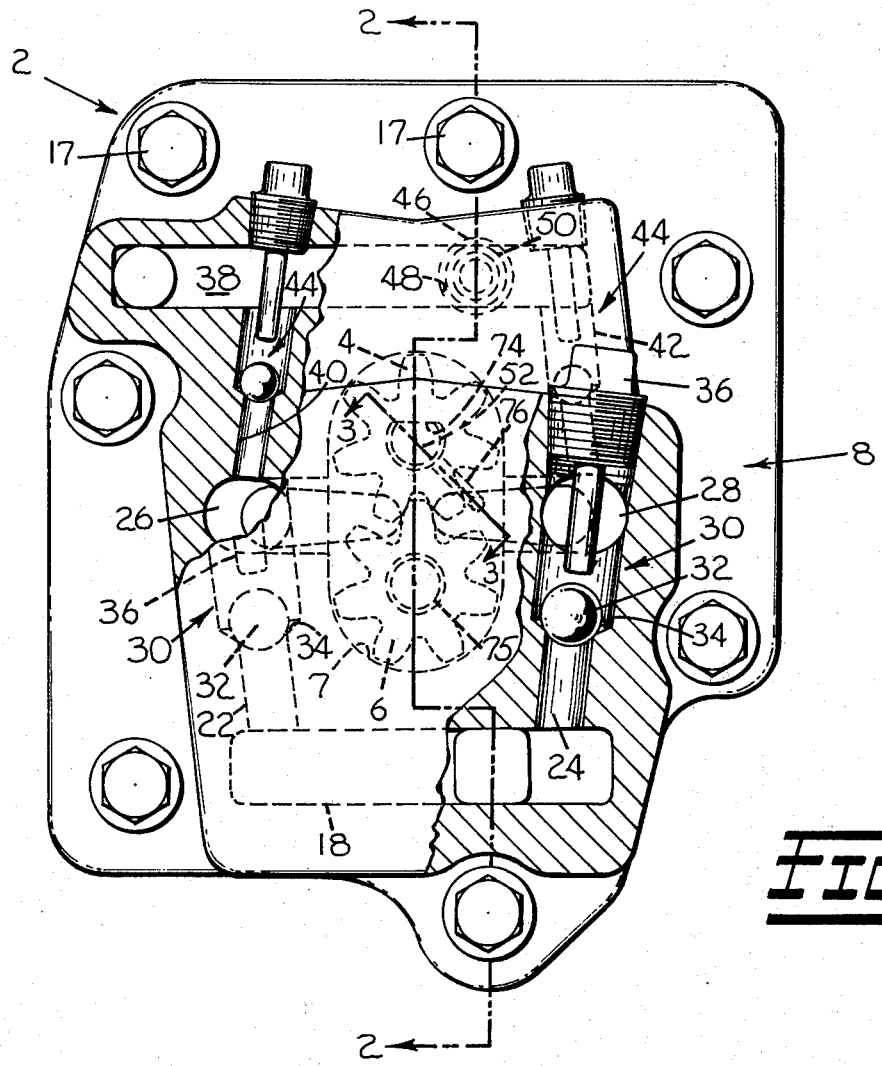
FIG. 1 is a front view partially in sections of the reversible lubricant pump, including various features of the invention.

As seen in the figures, the preferred reversible lubricant pump 2 is a gear pump having a drive gear 4 and a driven gear 6 disposed within a cavity 7 of a pump housing 8.

The same pump 2 may be utilized with either a forward axle assembly or rear axle assembly. The only features which are different when the pump is utilized in one assembly or the other is in the configuration of the pump supply lines to the various components within the assembly. The specific supply lines are not shown but are adapted to supply lubrication to various components including the input shaft bearings and, in the case of the forward axle assembly, the interaxle differential.

The pump housing 8 includes an interior body portion 10 and an exterior body portion 12 and is adapted to be received within an opening 14 of the axle helical gear cover 16 which is part of the casing which encloses the axle assembly. Gaskets 15 are provided to prevent lubricating oil from leaking from the axle helical gear cover 16 and the housing 8. The pump 2 includes a common inlet passageway 18 which when installed on the cover 16 by bolts 17 is aligned with an interior passageway 20 of the cover 16.

The interior passageway 20 extends inwardly to the interior of the cover 16 and is capable of receiving lubricating oil from the bottom of the axle assembly oil sump 19. A screen 21 at the intake of the passageway 20 is utilized to remove impurities which might interfere with pump operation.

Intersecting the common inlet passageway 18 are a "forward" supply line 22 at the left of FIG. 1 and a "reverse" supply line 24 at the right. Each supply line 22, 24, respectively, communicates with a feed and discharge port 26 and 28 at the left and right sides, respectively, of the gears 4 and 6. When the axle is being operated in the forward direction, the drive gear 4 will rotate in a clockwise direction and the driven gear 6 in the counterclockwise direction to pump oil from port 26 to port 28. Lubricating oil being supplied port 26 during forward operation is drawn through the interior passageway 20 into the common inlet passageway 18 and through the forward supply line 22. When operating in the reverse direction, the drive gear 4 rotates counterclockwise and the driven gear 6 clockwise to pump oil by way of supply line 24 from port 28 to port 26.

Each supply line 22, 24 includes a ball check valve 30 allowing oil to pass to the gears 4, 6 but preventing the gears 4, 6 from discharging to the common inlet passageway 18. The ball check valve 30 includes a ball 32 capable of resting on a seat 34 when a back pressure is applied. A plug and pin assembly 36 allows upward movement of the ball 32 but insures its retention near the seat 34 to prevent flow toward the common inlet passageway 18 when its respective supply line 22, 24 is not in use. The ball 32 of the preferred reversible lubricant pump 2 is made of steel but might alternatively be made of a light plastic material such as nylon to insure that the supply lines 22, 24 will be gravity filled by lubricating oil from the sump prior to operation.

The pump 2 also includes a common outlet passage 38. The common outlet passage 38 is aligned with pump supply lines (not shown) within the axle helical gear cover 16 to provide lubrication for the various components within its respective axle assembly. Intersecting the common outlet passage 38 are a reverse discharge line 40 and a forward discharge line 42 which respectively communicate with the feed and discharge ports 26 and 28. Each discharge line 40, 42 includes a ball check valve 44 similar to the ball check valve 30 described hereinabove. The ball check valve 44 allows passage of oil from the gears 4, 6 to the common outlet passage 38 but prevents oil from passing from the common outlet passage 38 back into the interior of the pump 2.

It should be apparent that the configuration thus described for the preferred reversible lubricant pump 2 will cause oil to be drawn from the oil sump 19 and supplied to various components of the axle assembly whenever the gears 4 and 6 are operated in either the forward or the reverse directions. To regulate the oil pressure provided by the pump 2, a relief valve 46 is provided. The relief valve 46 is located in an opening 48 within the housing 8 which extends from the common outlet passage 38 to the interior of the axle helical gear cover 16. A spring loaded ball valve 50 is normally closed but an increase in oil pressure to a predetermined level within the common outlet passage 38 will cause the ball valve 50 to be opened to release oil for eventual return to the sump 19.

The pump 2 thus being capable of providing lubricating oil to the various components of the asembly must be coupled to an input axle shaft (not shown) to provide the lubrication whenever the assembly is in operation. To insure effective operation under the demanding working conditions of a heavy duty vehicle, the driving means for the pump 2 must be rugged and reliable. Accordingly, the drive gear 4 is mounted on the first end 52 of a pump shaft 54. The pump shaft 54 is mounted for rotation within a bearing 56 which extends through the interior body portion 10 of the housing 8 and includes at its opposite ends bronze bushings 57. A second end 58 of the pump shaft 54 is located within the axle helical gear cover 16 where a pump gear 60 is mounted thereon. Specifically, the second end 58 includes a raised portion 62 and a spline 64 to prevent axial and radial movement between the pump shaft 54 and the pump gear 60 which is tightly received thereon. With the intermediate portion 66 of the pump shaft 54 received within the bearing 56, the first end 52 extends into the exterior body portion 12 of the housing 8. A circumferential groove 68 receives a snap ring 70 which entraps a washer 72 against the interior end of the bearing 56 to retain the pump shaft 54 therein when the pump gear 60 is mounted on the second end 58. To prevent relative rotation between the pump shaft 54 and the gear 4, the first end 52 of the pump shaft 54 has a D-shaped cross section. A matching D-shaped hole 74 through the drive gear 4 provides simple, reliable coupling therebetween. The driven gear 6 is, on the other hand, rotatably mounted on a stationary shaft 75 which is pressed into an opening 77 in the interior portion 10.

Figure 3:
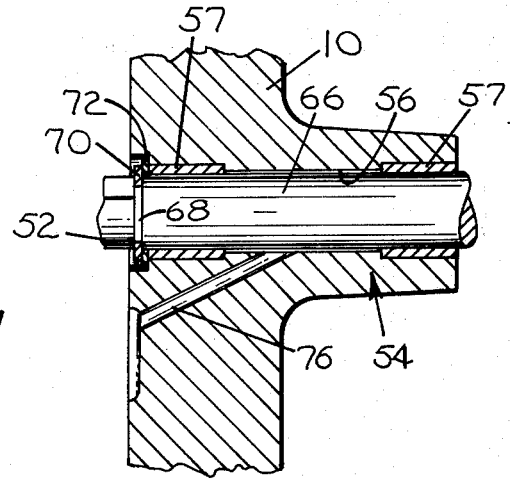
FIG. 3 is a view as seen along line 3—3 of FIG. 1.

To further insure long-lasting, effective operation, a positive means of lubricating the bearing 56 of the shaft 54 is provided by a lubricating port 76 which extends from the feed and discharge port 28 to the interior of the bearing 56 as shown in FIG. 3. In the preferred embodiment it is felt that positive lubrication in the forward mode of operation is sufficient for most applications. However, an additional lubricating port from the feed and discharge port 26 might be provided if desired.

To cause the pump gear 60, and thus the pump 2, to respond to rotational movement of the input axle shaft of the assembly, an idler gear 78 is provided. The idler gear 78 is aligned with and is engaged with both the input axle shaft and the pump gear 60 and is located therebetween to cause the pump gear 60 to respond to rotation of the input shaft. The effectiveness and reliability of the idler gear 78 is accordingly necessary for satisfactory pump operation. The preferred idler gear 78 is mounted on a ball bearing 80 at an interior end 82 of an idler gear shaft 84 as a circumferential lip 85 rests against the outer race of the bearing 80. A head 86 on the interior end 82 generally prevents axial withdrawal of the shaft 84 from the bearing 80. An intermediate portion 87 of the idler gear shaft 84 extends from the interior end 82 through a hole 88 in the axle helical gear cover 16 so that the other end 90 extends outwardly of the cover 16. The portion 87 is pressed into the hole 88 to prevent oil from leaking through the cover 16. The end 90 of the idler gear shaft 84 is threaded to receive a washer and lock nut retaining means 92 thereon to positively locate the idler gear shaft 84 within the cover 16.

Figure 4:
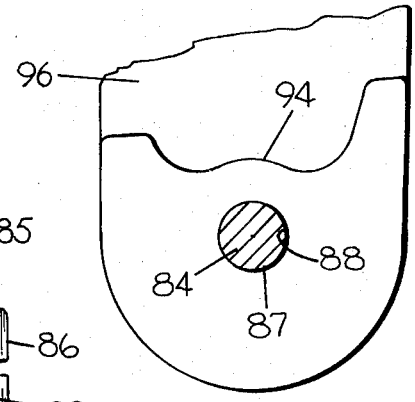
FIG. 4 is a view as seen along line 4—4 of FIG. 2.
Figure 2:
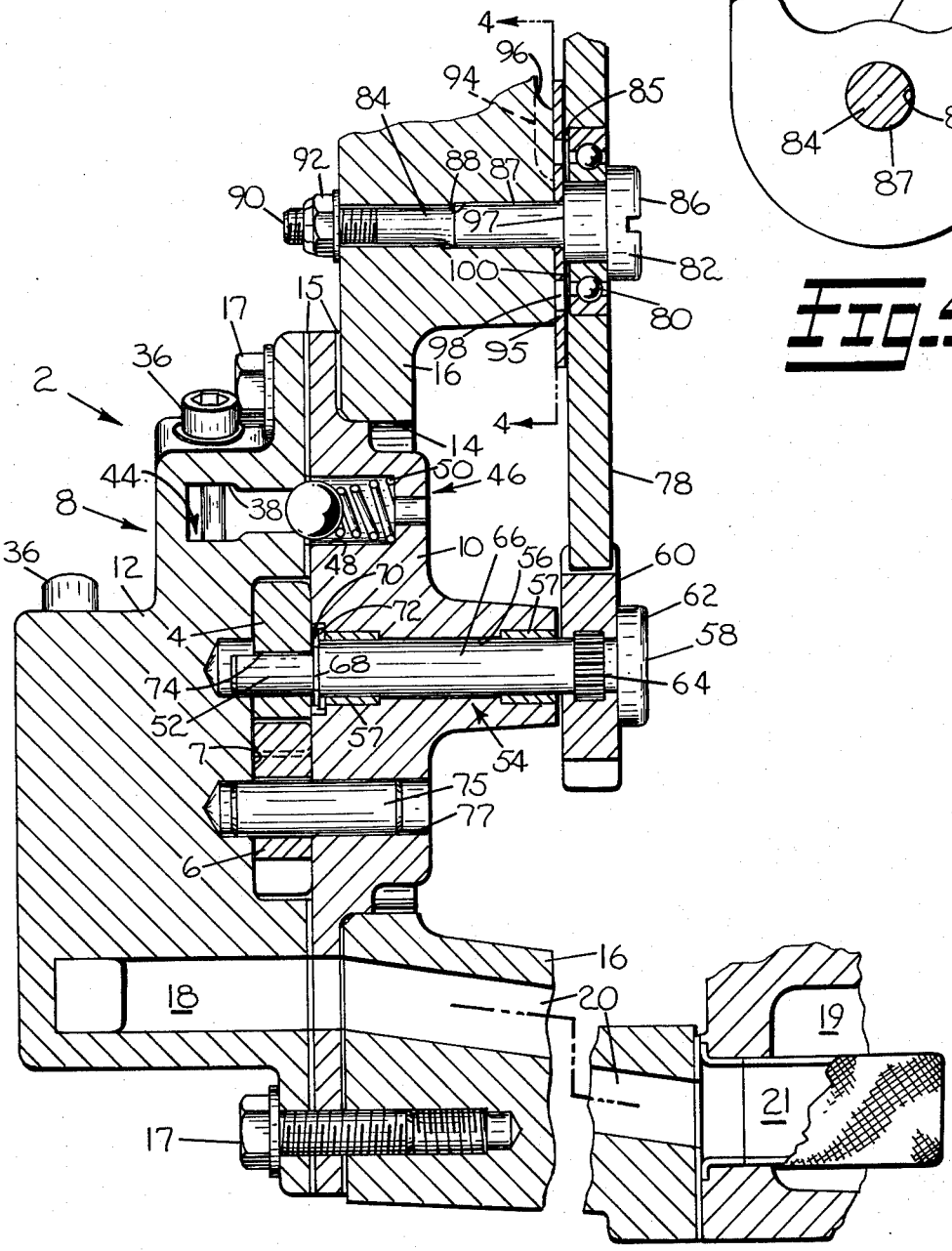
FIG. 2 is a view of the embodiment shown in FIG. 1 as seen along line 2—2 and showing portions of an axle assembly casing.

To prevent failure of the ball bearing 80, the axle helical gear cover 16 has been formed, as seen in FIG. 4, to include an oil pocket 94. The oil pocket 94 is on the interior wall 96 of the casing 16 above the idler gear shaft 84 and adjacent a spacer washer 95 between the wall 96 and a shoulder 97 of the shaft 84. General lubrication within the axle assembly is provided by splashing oil from oil sump 19 during rotation of the assembly. Oil pocket 94 insures that a sufficient quantity of oil to prevent its failure will be retained at the bearing 80 of the idler gear 78. Specifically, the spacer washer 95 includes a plurality of holes 98 therethrough, some of which will be aligned with the pocket 94 to allow oil to pass into the opening 100 between the bearing 80 and washer 95. The oil is drawn from the opening 100 to the bearing 80 as it rotates thereby.

While the preferred embodiment described hereinabove provides features directed to the effective, reliable operation of the reversible lubricant pump, there are included additional features, as seen from the figures, which are directed at simplified installation and maintenance. Specifically, if a vehicle were initially bought without an installed lubricant pump, the idler gear would be provided but a cover plate would be installed over the opening in the axle cover, the interior passage from the sump, and the supply lines to the various components which would still allow use of the axle assembly while relying on the older splashing oil lubrication system. Should it later be found that a reversible lubricant pump is desired, the cover plate could be removed and replaced with the pump for operation as described above. Additionally, the internal and external portions of the pump housing allow easy access to the interior of the pump for routine or corrective maintenance. The means by which the drive gear and the driven gear are mounted on their respective shafts provides for their easy removal once the interior and exterior portions of the housing are separated.

It is felt that the invention and many of its attendant advantages will be understood from the foregoing description and it will be apparent that various changes may be made in the form, construction and arrangement of the various elements thereof without departing from the spirit and scope of the invention as claimed or sacrificing its material advantages.

What is claimed is:

1. A reversible lubricant pump capable of supplying lubricating oil to various components of one of a pair of tandem drive axle assemblies which assemblies include an axle casing and an oil sump, said pump comprising:

a pump housing having a common inlet passage and a common outlet passage and capable of being sealably received within an opening of said axle casing as said common inlet passage communicates with said oil sump and said common outlet passage communicates with said components;

a drive gear and a driven gear mounted for engaged rotation within a pump cavity of said housing between a first and a second oil port for said rotation in a first direction to pump said oil from said first port to said second port and in an opposite direction to pump said oil from said second port to said first port;

a first supply line and a second supply line within said housing between said common inlet passage and said first and said second ports respectively;

each said supply line having a check valve to prevent the flow of said oil therethrough in a direction toward said common inlet passage;

a first discharge line and a second discharge line within said housing between said common outlet passage and said first and second ports respectively;

each said discharge line having a check valve to prevent the flow of said oil therethrough in a direction away from said common outlet passage;

said drive gear being rigidly mounted on a first end of a pump shaft which said pump shaft is mounted for rotation within a bearing within said housing;

said pump shaft having a second end extending from within said housing to within said axle casing and having a pump gear fixedly mounted thereon;

means for engaging said pump gear and for rotation thereof in response to movement of an input axle shaft of said axle assembly when said housing is received within said opening of said axle casing; and a lubricating port within said housing extending from said second oil port to the interior of said bearing to provide lubrication to said pump shaft during operation of said axle assembly.

2. A reversible lubricant pump as set forth in claim 1, wherein said first end of said pump shaft is D-shaped to be received within a matching D-shaped hole in said drive gear to prevent relative rotation therebetween.

3. A reversible lubricant pump as set forth in claim 2, wherein said pump shaft has a circumferential groove thereabout which is axially located inwardly of said first end to receive a snap ring, said snap ring prevents a washer which closely encircles said pump shaft from axial movement toward said first end and said washer makes sliding contact with an inward end of said bearing to prevent accidental withdrawal of said pump from said bearing.

4. A lubrication system for supplying lubricating oil to various components of one of a pair of tandem drive axle assemblies, said one assembly including an input shaft, an axle casing, and an oil sump, said lubricating system comprising:

a reversible lubricant pump having a housing and being sealably mounted at an opening of said axle casing;

a drive gear and a driven gear of said pump being mounted within a cavity of said housing for engaged rotation in either direction to pump said oil from said sump to said various components of said one assembly;

said drive gear being rigidly mounted on a first end of a pump shaft which said pump shaft is mounted for rotation within a bearing within said housing;

said pump shaft having a second end extending from within said housing to within said axle casing and having a pump gear fixedly mounted thereon;

an idler gear mounted for rotation within said axle casing in alignment with and in engaging contact with both said input shaft and said pump gear to cause said pump gear to respond to rotational movement of said input axle shaft in either direction of said rotational movement;

means for lubricating said bearing of said pump shaft with said oil when said input axle shaft moves in at least one of said directions;

said idler gear being mounted on a ball bearing at a first end of an idler gear shaft for rotation thereabout, said idler gear shaft extending from within said axle casing through a hole in said casing to a second end thereof outwardly of said axle casing; and said second end being threaded to receive a nut thereof for retention of said idler gear shaft within said hole.

5. A lubricating system as set forth in claim 4, wherein said axle casing above said idler gear shaft is formed to provide an oil pocket aligned with said ball bearing to provide lubrication therefor during rotation of said idler gear.

* * * * *